US009653204B2

(12) United States Patent
Vanukuru

(10) Patent No.: US 9,653,204 B2
(45) Date of Patent: May 16, 2017

(54) SYMMETRIC MULTI-PORT INDUCTOR FOR DIFFERENTIAL MULTI-BAND RF CIRCUITS

(71) Applicant: INTERNATIONAL BUSINESS MACHINES CORPORATION, Armonk, NY (US)

(72) Inventor: Venkata N. R. Vanukuru, Karnataka (IN)

(73) Assignee: GLOBALFOUNDRIES INC., Grand Cayman (KY)

( * ) Notice: Subject to any disclaimer, the term of this patent is extended or adjusted under 35 U.S.C. 154(b) by 6 days.

(21) Appl. No.: 14/602,567

(22) Filed: Jan. 22, 2015

(65) Prior Publication Data

US 2016/0217904 A1 Jul. 28, 2016

(51) Int. Cl.

| | |
|---|---|
| ***H01F 27/28*** | (2006.01) |
| ***H01F 5/00*** | (2006.01) |
| ***H01F 27/29*** | (2006.01) |
| ***H01F 17/00*** | (2006.01) |

(52) U.S. Cl.

CPC ..... *H01F 27/29* (2013.01); *H01F 17/0006* (2013.01); *H01F 2017/0046* (2013.01); *H01F 2017/0073* (2013.01)

(58) Field of Classification Search

CPC ..... H01F 27/28; H01F 27/29; H01F 27/2804; H01F 5/003; H01F 17/006

USPC ..... 336/200, 223, 192, 147, 146

See application file for complete search history.

(56) References Cited

U.S. PATENT DOCUMENTS

| | | | | |
|---|---|---|---|---|
| 6,380,835 | B1 | 4/2002 | Lee | |
| 6,867,677 | B2 | 3/2005 | Nielson | |
| 6,922,128 | B2 | 7/2005 | Vilander et al. | |
| 6,992,366 | B2 | 1/2006 | Kim et al. | |
| 7,312,683 | B1 | 12/2007 | Lee | |
| 7,733,206 | B2 | 6/2010 | Park | |
| 8,274,353 | B2 | 9/2012 | Barrett et al. | |
| 8,531,250 | B1 * | 9/2013 | Luschas | H03B 5/1228 257/531 |
| 2003/0210121 | A1 | 11/2003 | Beng et al. | |
| 2004/0017278 | A1 | 1/2004 | Castaneda et al. | |
| 2004/0041234 | A1 | 3/2004 | Sia et al. | |
| 2004/0140528 | A1 * | 7/2004 | Kim | H01F 21/12 257/537 |
| 2007/0115086 | A1 | 5/2007 | Cairo Molins | |
| 2007/0158782 | A1 * | 7/2007 | Heikkinen | H01F 17/0006 257/531 |
| 2011/0133875 | A1 | 6/2011 | Chiu et al. | |

(Continued)

OTHER PUBLICATIONS

Krishnapura et al., "Compact low pass ladder filters using taped coils", IEEE International Symposium on Circuits and Systems (ISCAS), 2009, pp. 53-56.

(Continued)

*Primary Examiner* — Mangtin Lian

(74) *Attorney, Agent, or Firm* — David Cain; Andrew M. Calderon; Roberts Mlotkowski Safran Cole & Calderon, P.C.

(57) ABSTRACT

Structures and methods for implementing high performance symmetric multi-port inductors are provided. The multiport inductor structure includes a plurality of conductors which are structured and arranged in turns to obtain symmetry between a plurality of selected input terminals connecting to respective ones of the plurality of conductors.

17 Claims, 6 Drawing Sheets

(56) References Cited

U.S. PATENT DOCUMENTS

2015/0130291 A1* 5/2015 Lim ..... H01Q 1/2225
307/104
2015/0130579 A1* 5/2015 Kim ..... H01F 27/2804
336/200

OTHER PUBLICATIONS

Dehan et al., "Tapped integrated inductors: Modelling and Application in Multi-Band RF Circuits", IEEE European Microwave Integrated Circuit Conference (EuMIC), Oct. 2008, pp. 234-237.
Ito et al., "Characterization of on-chip multiport inductors for small-area RF circuits", IEEE Transactions on Circuits and Systems I: Regular Papers, vol. 56, No. 8, Aug. 2009, pp. 1590-1597.
Lopez-Villegas et al., "Improvement of the quality factor of RF integrated inductors by layout optimization", IEEE Transactions of Microwave Theory and Techniques, vol. 48, No. 1, Jan. 2000, pp. 76-83.
Zolfaghari et al., "Stacked inductors and transformers in CMOS technology", IEEE Journal of Solid-State Circuits, vol. 36, No. 4, Apr. 2001, pp. 620-628.
Application and Drawings for U.S. Appl. No. 14/018,451, filed Sep. 5, 2013, 29 pages, not yet published.
"List of IBM Patents or Patent Applications Treated as Related" submitted concurrently herewith; 1 page.

* cited by examiner

SYMMETRIC MULTI-PORT INDUCTOR FOR DIFFERENTIAL MULTI-BAND RF CIRCUITS

FIELD OF THE INVENTION

The present invention relates generally to semiconductors, and more particularly, to structures and methods for implementing high performance symmetric multi-port inductors.

BACKGROUND

An inductor is one of the most important components for an electric circuit with a resistor, a capacitor, a transistor and a power source. The inductor has a coil structure where a conductor is wound many times as a screw or spiral form. The inductor suppresses a rapid change of a current by inducing the current in proportion to an amount of a current change. Herein, a ratio of counter electromotive force generated due to electromagnetic induction according to the change of the current flowing in a circuit is called an inductance (L).

Generally, the inductor is used for an Integrated Circuit (IC) for communication. High performance RF filters, and distributed amplifiers, such as those utilizing CDMA and/or GSM frequency bands, utilize inductors. In particular, inductors are used in a packaging technology for integrating many elements to a single chip, known as a System on Chip (SoC). Accordingly, an inductor having a micro-structure and good characteristics is needed. Particularly, in the case of implementing the inductor on a single wafer, the inductor formed on a substrate has considerable space requirements, which needs to be reduced due to the need to scale devices and add more density to the chip.

SUMMARY

In an aspect of the invention, a multiport inductor structure comprises a plurality of conductors which are structured and arranged in turns to obtain symmetry between a plurality of selected input terminals connecting to respective ones of the plurality of conductors.

In an aspect of the invention, a multiport symmetric inductor structure, comprises: a plurality of conductors structured and arranged into a plurality of turns and sections comprising metal wiring segments; and input terminals connecting to different wiring structures comprising the metal wiring segments of each of the sections, such that the turns and the connection arrangement of the input terminals provide plural symmetric spirals between different selected pairs of input terminals.

In an aspect of the invention, a multiport symmetric inductor structure comprises a plurality of conductors which are structured and arranged in spiral turns to obtain symmetry between a plurality of selected input terminals connecting to respective ones of the plurality of conductors. The plurality of conductors comprises: a first section of serially stacked turns of metal wiring structures, each having segments on a first layer and a second layer, the segments of the first layer having a different width and spacing corresponding to the width and spacing on the second layer; a second section of parallel stacked turns of metal wiring structures, each having segments on the first layer and the second layer, the segments of the first layer having a different width and spacing corresponding to the width and spacing on the second layer; and a third section of non-stacked metal wiring structures. The symmetry between the selected input terminals comprise: terminals taken between outermost pair of spirals; terminals taken between intermediate pair of spirals; and terminals taken between innermost pair of spirals.

BRIEF DESCRIPTION OF THE SEVERAL VIEWS OF THE DRAWINGS

The present invention is described in the detailed description which follows, in reference to the noted plurality of drawings by way of non-limiting examples of exemplary embodiments of the present invention.

DETAILED DESCRIPTION

Figure 1:
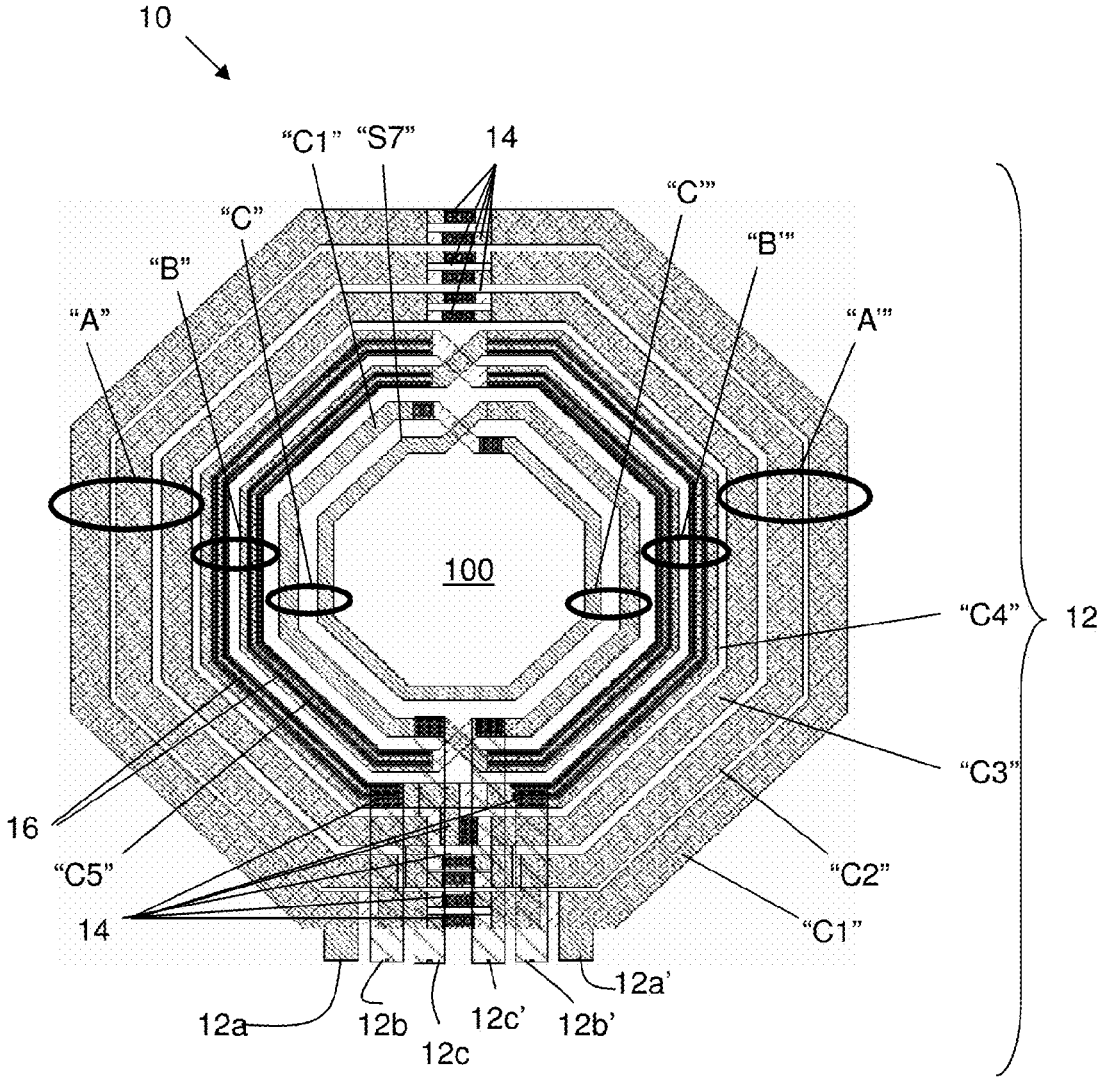
FIG. 1 shows an upper layer of metal wiring structures (conductors) of a symmetric multi-port inductor in accordance with aspects of the invention.

The present invention relates generally to semiconductors, and more particularly, to structures and methods for implementing high performance multi-port inductors. More specifically, the present invention is directed to symmetric multi-port inductors for differential multi-band RF circuits. Advantageously, the symmetric multi-port inductors described herein have significantly reduced area or space, compared to conventional inductors. Moreover, the symmetric multi-port inductors described herein have improved performance over a wide range of frequency bands, and can be used in SOI technologies.

More specifically, the symmetric multi-port inductors described herein are high performance multi-port inductor structures compatible with CMOS process, which exhibit the following advantages:

(i) occupies much lesser area than conventional inductors;

(ii) exhibits higher Qs across different frequency bands;

(iii) exhibits high inductance density across the different frequency bands;

(iv) provides flexibility to maximize performance at any desired frequency band; and (v) provides excellent electric characteristics especially with (high resistivity) HR technologies.

In embodiments, the symmetric multi-port inductor is a 3-D multiport symmetric inductor structure composed of multiple (e.g., three) spiral sections of wiring structures (conductors) each of which have the feature of varying width and spacing, where the width reduces gradually going from outer to the inner turns and the spacing does the opposite. The symmetric multi-port inductor exhibits perfect symmetry between terminals (also known as ports), for implementation in differential applications. The symmetric multi-port inductor further includes series wound spirals (or other wound configurations as described herein) which utilize one or more parallel stacked metals (metal wiring structures or conductors). In embodiments, the parallel stacking increases the Q for lower frequency bands, and also has the advantages that the metal wiring structures (conductors) in the parallel stacked configuration can be broken (tapped) at any location and still provide the functionality described herein.

In operation, by implementing the symmetric multi-port inductors described herein, it is possible to obtain the following operational functions and features:

(i) Frequency band selection: By using the symmetric multi-port inductor, it is possible to obtain multiple frequency bands with a single structure of reduced area (compared to conventional structures). For example, ports (terminals) taken between outermost pair of spirals can be used at lowest frequency band; whereas, ports (terminals) taken between the intermediate pair of spirals comprise an inductor to be used at intermediate frequency band and ports (terminals) taken between the innermost pair of spirals comprise an inductor to be used at highest frequency band;

(ii) Achieve higher Qs at given frequency bands: The location of the solenoidal series and parallel stacking of the metal wiring structures can be interchanged according to the Q requirements of lower and intermediate frequency bands; and (iii) Frequency band spacing: By using the symmetric multi-port inductor, it is possible to adjust the frequency band of any band selection. For example, the rate at which the width and spacing of the turns of the metal wiring structures (conductors) change going from the exterior to interior is directly proportional to the frequency band spacing. Accordingly, wide outer turns with wide metal wiring structures or narrow inner turns and narrow metal wiring structures can be used for high L and Q at low frequency bands. Thus, by simply adjusting spacing and/or width of the metal wiring structures, it is possible to adjust inductance for different frequency bands.

The symmetric multi-port inductors of the present invention can be manufactured in a number of ways using a number of different tools. In general, though, the methodologies and tools are used to form structures with dimensions in the micrometer and nanometer scale. The methodologies, i.e., technologies, employed to manufacture the symmetric multi-port inductors have been adopted from integrated circuit (IC) technology. For example, the structures of the present invention are built on wafers and are realized in films of material patterned by photolithographic processes on the top of a wafer. In particular, the fabrication of the symmetric multi-port inductors uses three basic building blocks: (i) deposition of thin films of material on a substrate, (ii) applying a patterned mask on top of the films by photolithographic imaging, and (iii) etching the films selectively to the mask.

Figure 2:
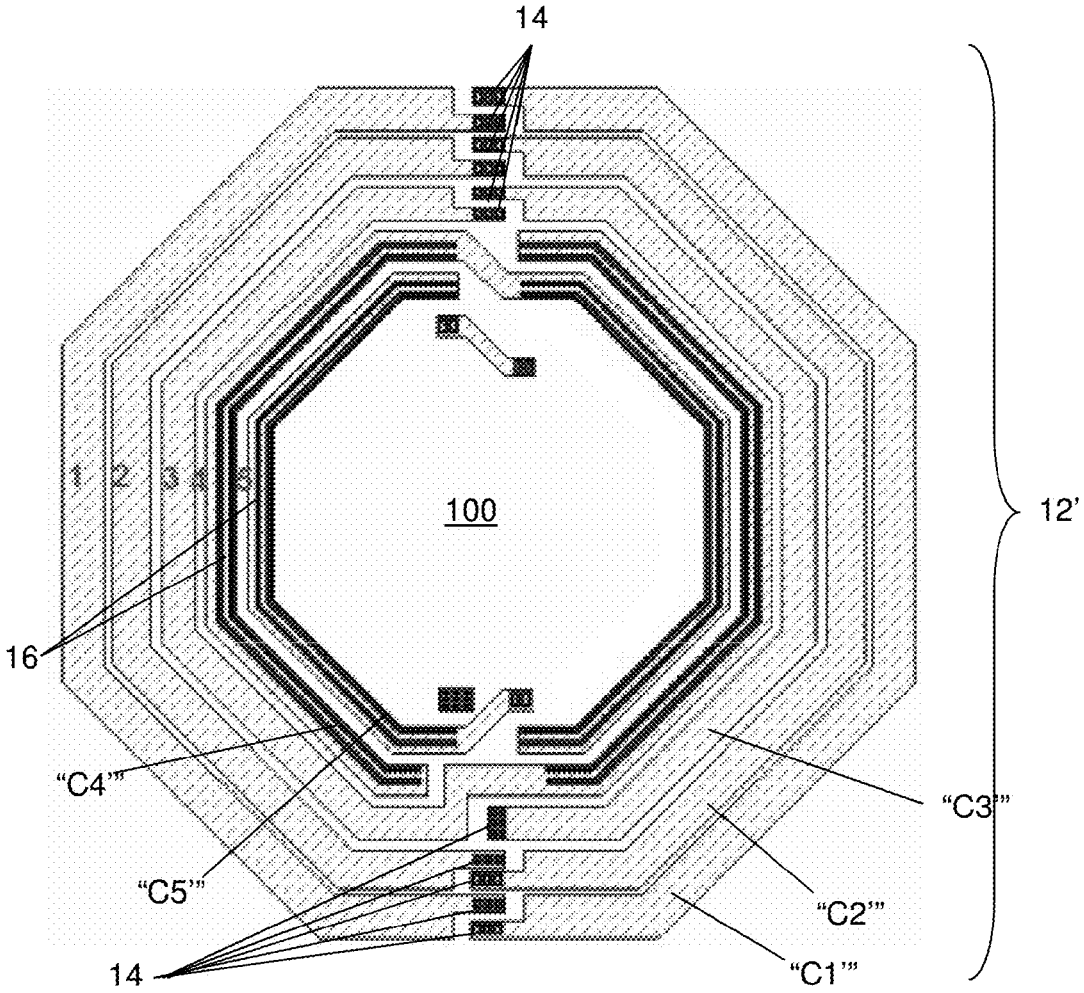
FIG. 2 shows a lower layer of metal wiring structures (conductors) of the symmetric multi-port inductor in accordance with aspects of the invention.
Figure 3:
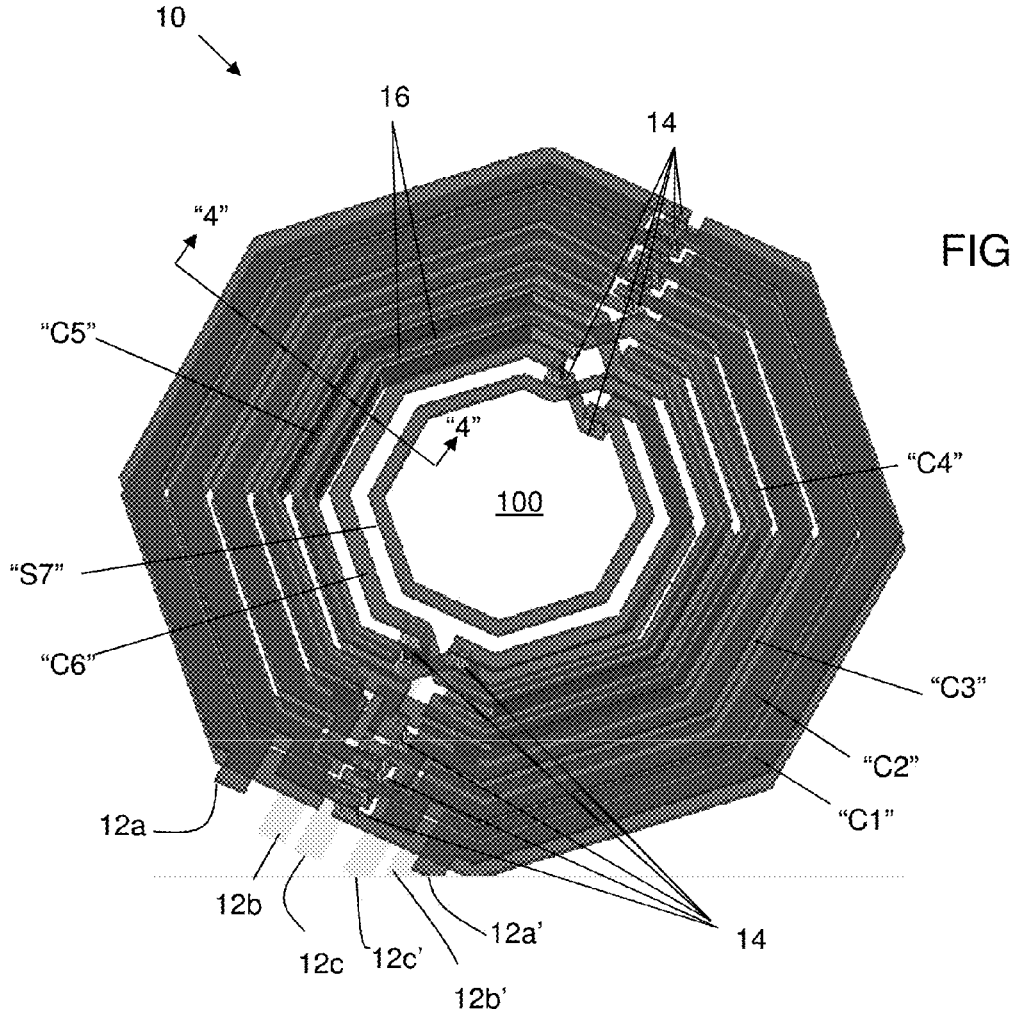
FIG. 3 shows an isometric view of the symmetric multi-port inductor in accordance with aspects of the invention.

FIGS. 1-3 show a symmetric multi-port inductor in accordance with aspects of the invention. More specifically, FIG. 1 shows an upper layer of metal wiring structures (conductors) 12 of the symmetric multi-port inductor 10; whereas, FIG. 2 shows a lower layer of metal wiring structures (conductors) 12' of the symmetric multi-port inductor 10 and FIG. 3 shows an isometric view of the symmetric multi-port inductor 10. As described in more detail herein, and as shown more specifically in FIG. 1-3, the symmetric multi-port inductor 10 is perfectly symmetrical between pairs of terminals: 12*a*/12*a*', 12*b*/12*b*' and 12*c*/12*c*'. The outer circle indicates the series spirals, the middle circle indicates parallel spirals and the inner circle indicates the single-layered spirals. Also, although the symmetric multi-port inductor 10 is described with regard to a spiral structure, one of skill in the art would understanding that the upper layer of metal wiring structures (and lower layer of metal wiring structures shown in FIGS. 2 and 3) may be formed in any number of different shapes, including octagonal, square, rectangle, circular, hexagon, etc.

As shown more specifically in FIG. 1, the upper layer of metal wiring structures (upper conductors) 12 includes seven upper "spiral" segments (e.g., metal wiring segments) comprising C1, C2, C3, C4, C5, C6 and C7. The spiral metal wiring structures (conductors) of the multiport inductor structure 10 can be made of any metal material, for example, copper, tungsten, aluminum, or other suitable conductors or combinations thereof using conventional CMOS fabrication processes as noted herein. Also, although the metal wiring structures are shown in a spiral configuration with a certain number of spirals, other configurations are also contemplated herein, e.g., more or less than seven spiral wiring segments and different shapes as shown and described with regard to at least FIGS. 5 and 6.

Referring to FIGS. 1-3, the upper wiring segments C6 and C7 is illustrative of a single stacked wiring structure (e.g., the upper wiring segment C6 and C7 are not stacked with any lower wiring layer); whereas, the upper wiring segments C1, C2, C3, C4, and C5 are multiple stacked wiring segments, corresponding to a lower layer of metal structures (lower conductors) 12' of the symmetric multi-port inductor 10. More specifically, the lower layer of metal wiring structures (lower conductors) 12' includes lower wiring segments C1', C2' and C3', which are serially connected to the respective upper wiring segments C1, C2, and C3 by via interconnects 14 (in dielectric material), thus forming an inductive wiring structure. On the other hand, in embodiments, the lower metal wiring segments C4' and C5' are connected in parallel to the respective upper wiring segments C4 and C5 by a plurality of via interconnects 16 along their lengths, thus forming an effectively thick inductive wiring structure. In this way, the connected lower wiring segments C4' and C5' and respective upper wiring segments C4 and C5 exhibit a low resistance and, in embodiments, it is possible to tap or break any of these lines without affecting the overall functionality of the symmetric multi-port inductor 10. Although shown as aligned vertically, it should be noted that the upper and lower wiring structures (where solenoidal winding are provided) can have a slight offset instead of being perfectly aligned vertically to each other.

As further shown in FIGS. 1-3, a plurality of respective pairs of terminals 12*a*/12*a*', 12*b*/12*b*' and 12*c*/12*c*' are electrically connected to each of the metal wiring structures of the multiport inductor structure 10 as described herein. For example, (i) upper and lower wiring segments C1, C2 and C3 and C1', C2' and C3' are connected between terminals 12*a*/12*a*' representing symmetry "A"/"A'", (ii) upper and lower wiring segments C4 and C5 and C4' and C5' are connected between terminals 12*b*/12*b*' representing symmetry "B"/"B'", and (iii) upper wiring segments C5 and C6 are connected between terminals 12*c*/12*c*' representing symmetry "C"/"C'". By selecting any combination of pairs of the terminals, it is possible to select different frequency bands.

In embodiments, the multiport inductor structure 10 is perfectly symmetrical between these respective terminals. For example, between terminals 12*a* and 12*a*', symmetry (e.g., symmetric series connection between the top and bottom metal wiring structures) is obtained with all signal metal wiring structures represented by "A"/"A'", "B"/"B'" and "C"/"C'". That is, all of the turns result in a high "L" (inductance) for a low frequency band, i.e., include series+parallel+single layer. Similarly, between terminals 12*b* and 12*b*', symmetry (e.g., symmetric parallel connection between the top and bottom wiring structures) is obtained by metal wiring structures represented by "B"/"B'" and "C"/"C'"; that is, the turns result in a moderate "L" (inductance) for an intermediate frequency band, i.e., include only parallel+single layer. On the other hand, between terminals 12*c* and 12*c*', symmetry (e.g., symmetric single layer upper wiring structures) is obtained with only the metal wiring structures represented by "C"/"C'" (e.g., non-stacked upper wiring structures C6 and C7). This latter symmetry results in a low "L" (inductance) for a high frequency band, i.e., include only the single layer. This perfect symmetry is beneficial for differential applications such as a differential power amplifiers or a differential VCO, as examples.

Figure 4:
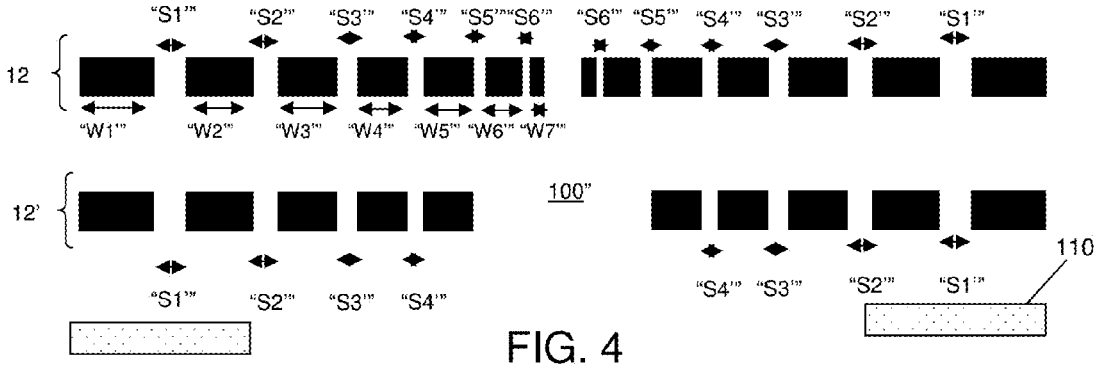
FIG. 4 shows a cross-sectional view of the multiport inductor structure 10, along line 4-4 of FIG. 3.

FIG. 4 shows a cross-sectional view of the multiport inductor structure 10, along line 4-4 of FIG. 3. As shown in FIG. 4, the widths and spacings of each of the metal wiring structures (segments) can vary. For example, as shown in FIG. 4, each of the widths of the metal wiring segments on both layers 12, 12' decrease towards the center 100, while the spacing between each of the metal wiring segments increases. Specifically, as shown in FIG. 4, spacings S1-S6 between adjacent metal wiring segments increase between the adjacent metal wiring segments as winding toward the center 100 of the symmetric multi-port inductor 10; whereas, the widths W1-W7 of the metal wiring segments, on the other hand, decrease as winding toward the center 100 of the symmetric multi-port inductor 10. Illustratively, the spacing increases from about 6 nanometers to about 9 nanometers (spacing S1) to about 20 nanometers to about 30 nanometers (spacing S6), e.g., S1<S2<S3<S4<S5<S6; whereas, conversely, the widths of the metal wiring structures, decrease from about 26 nanometers to about 33 (width W1) to about 6 nanometers to about 9 nanometers (width W7), e.g., W7<W6<W5<W4<W3<W2<W1.

The rate at which width and interspacing of the concentric structures change going from the exterior to the interior of the structure is directly proportional to the frequency band spacing. In general, when designing an inductor structure for use within a narrow frequency range, the interspacing changes more gradually from the outer bands towards the center of the structure. Conversely, when designing an inductor structure for use within a wider frequency range, the interspacing changes more aggressively from the outer bands towards the center of the structure. Hence, interspacing is an important parameter to consider when designing inductor structures in accordance with embodiments of the present invention. Accordingly, any of the upper and lower metal wiring structures can have varying thickness or width or spacing in order to adjust the frequency band.

By way of several illustrative, non-limiting examples:

(i) The width or the diameter of the conductors (e.g., upper wiring segments C1, C2, C3, C4, C5, C6 and C7 and lower wiring segments C1', C2', C3', C4' and C5') may be reduced at a constant rate or any other monotonic rate (including periodically constant) as winding toward the center 100 of the coil (symmetric multi-port inductor 10).

(ii) The space between each consecutive turn (S1-S6) can increase at a constant rate or any other monotonic rate (including periodically constant) as winding toward the center of the coil.

(iii) The width and spacing of the turns of the upper metal wiring segments C1, C2, C3, C4, C5, C6 and C7 can be made different from the turns of the lower metal wiring segments C1', C2', C3', C4' and C5', without disturbing the overall multiport inductor structure and operation. For example, it is contemplated herein to have wide outer turns with wide wirings of narrow inner turns with narrower wirings in order to obtain high "L" and "Q" at low frequency bands.

FIG. 4 also shows an optional patterned ground shield (PGS) 110. As in any of the embodiments described herein, the multiport inductor structure 10 can operate with or without a patterned ground shield (PGS) and also can selectively have a patterned ground shield only for the turns that correspond to lower frequencies as shown in FIG. 4.

Figure 5:
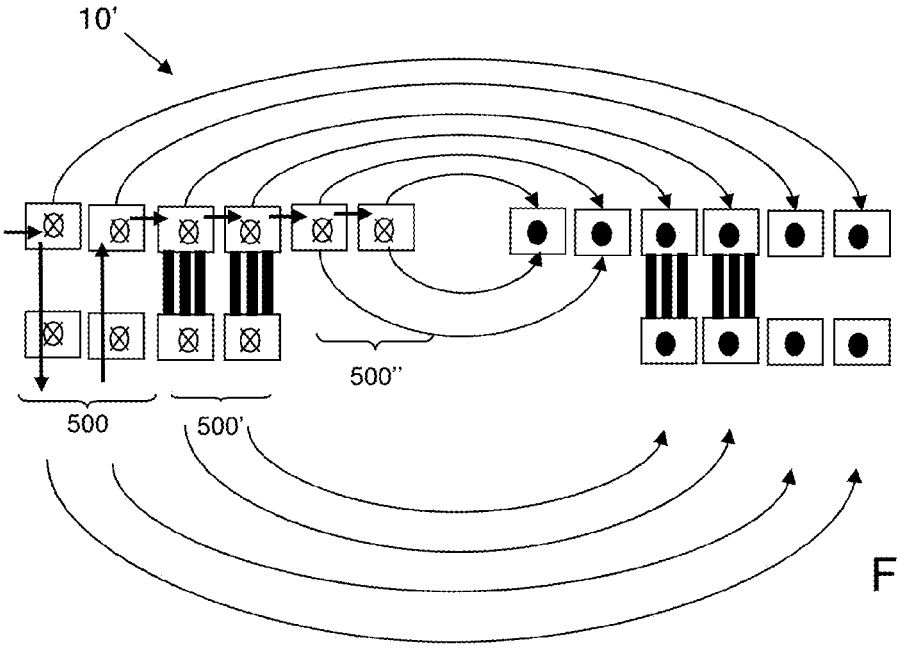
FIG. 5 shows a cross-sectional view of a symmetric multi-port inductor in accordance with another aspect of the present invention.

FIG. 5 shows a cross-sectional view of a symmetric multi-port inductor 10' in accordance with additional aspect of the present invention. In this representation, the arrows represent the direction of current through the symmetric multi-port inductor 10'. In FIG. 5, six windings are shown with preferably a spiral configuration. In this embodiment, the intermediate windings 500' are stacked in parallel, the inner most windings 500" are a single non-stacked layer, and the outermost windings 500 are stacked in series. As shown representatively, the intermediate windings 500' are stacked in parallel by use of a plurality of via interconnects 16 along their lengths.

As should be understood by those of skill in the art, each of the windings 500, 500' and 500" can be of varying space and width as described herein, with the locations of solenoidal series (e.g., windings 500) and parallel stacking being interchangeable. Accordingly, each of these different windings can be used in certain combinations, as described herein, to obtain a certain frequency band, e.g., lowest frequency band, intermediate frequency band and highest frequency band. More specifically, by adjusting the spacing and widths, the series stacked metal wiring structures 500 can obtain a low frequency band (e.g., high 'L' and low 'R'), the parallel stacked spirals can obtain an intermediate frequency band (moderate 'L' and low 'R') and the single layer wiring structure 500'" can be used for high frequency band (low 'L' and low 'C').

Figure 6:
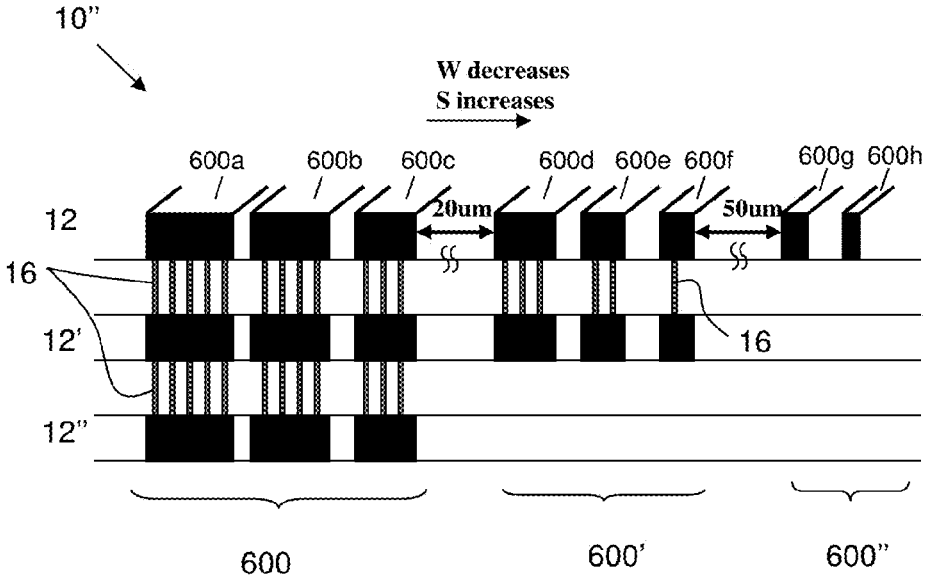
FIG. 6 shows another cross-sectional view of a symmetric multi-port inductor between two ports, in accordance with aspects of the present invention.

FIG. 6 shows another cross-sectional view of a symmetric multi-port inductor 10" between two ports, e.g., 12*b*, 12*b*' in accordance with different aspects of the present invention. In this aspect, the multi-port inductor 10" includes a first parallel winding 600 with three layers of wiring structures 12, 12' and 12" and three metal wiring structures 600*a*, 600*b* and 600*c*; whereas, a second parallel winding 600' shows the use of two layers of wiring structures 12, 12' with two three wiring structures 600*d*, 600*e*, 600*f*. This symmetric multi-port inductor 10" also includes a single stacked wiring structure 600" with two wires 600*g*, 600*h*.

In the configuration of FIG. 6, for example, the width of each of the wiring structures decreases, as the spacing increases. Also, the spacing between the first parallel winding 600 and the second parallel winding 600' can be about 20 nanometers, while the spacing between the second parallel winding 600' and the single stacked wiring structure 600" is about 50 nm; although other dimensions are also contemplated by the present invention. In this representation, the first parallel winding 600 can have a frequency of about 800-900 MHz, the second parallel winding 600' can have a frequency of about 1.8-2.4 GHz and the single stacked wiring structure 600" can have a frequency of about greater than 5.5 GHz, as an example.

Figure 7:
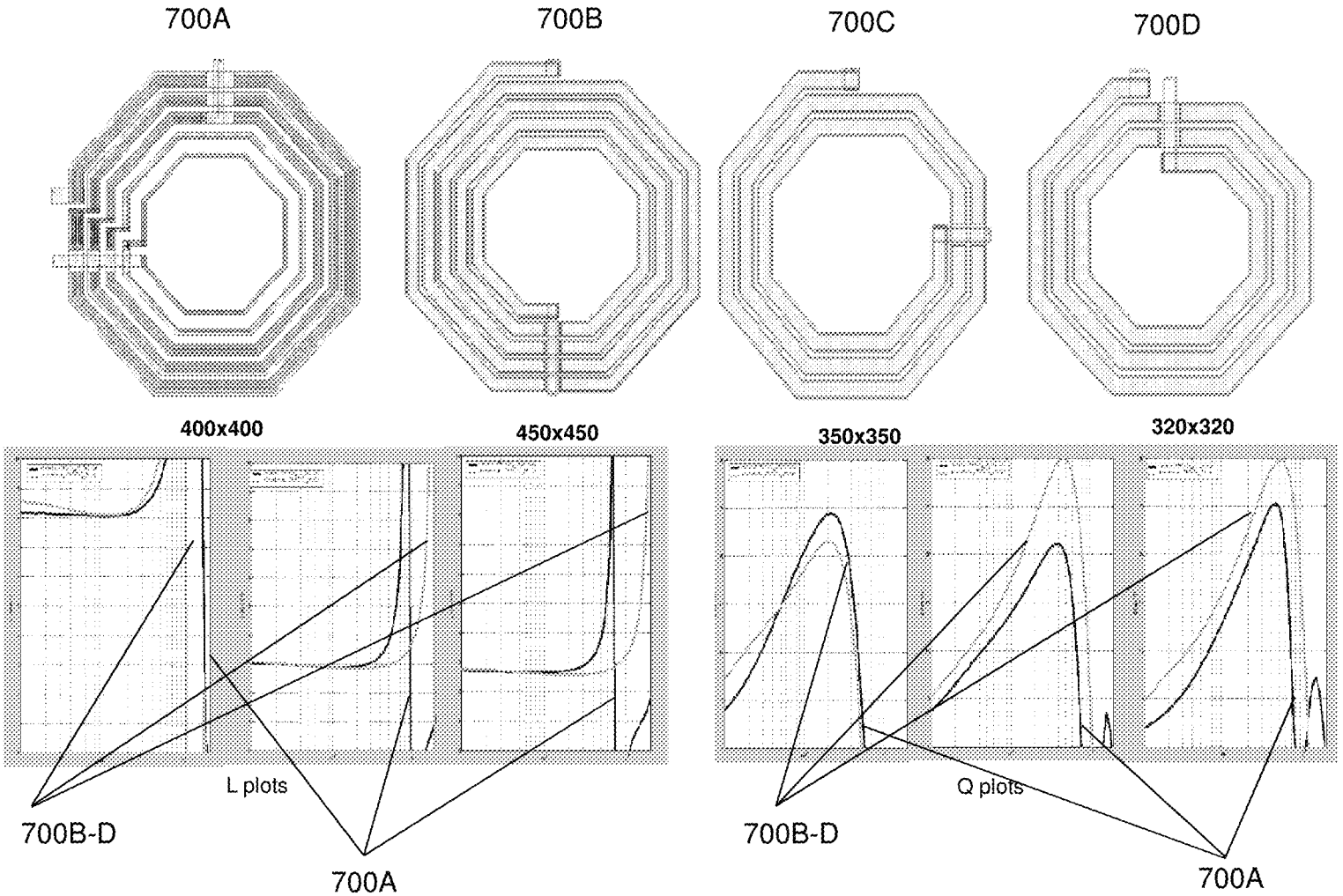
FIG. 7 shows comparison graphs between the multi-port inductors described herein and conventional inductors, demonstrating an area savings in accordance with aspects of the present invention.

FIG. 7 shows comparison graphs between the multi-port inductors described herein and conventional inductors. More specifically, the graphs shown in FIG. 7 demonstrate the area savings of the multi-port inductors 700A described herein when compared to discrete inductors shown at reference numerals 700B-700D. More specifically, the graphs of FIG. 7 show the L-plots and Q-plots of the multi-port inductors 700A and the three conventional inductors 700B-700D, for similar ranges. This demonstrates that by implementing the multi-port inductors 700A, it is possible to achieve three different frequency bands, similar to that obtained by the three conventional inductors 700B-700D, while providing an area savings of 3×.

Figure 8:
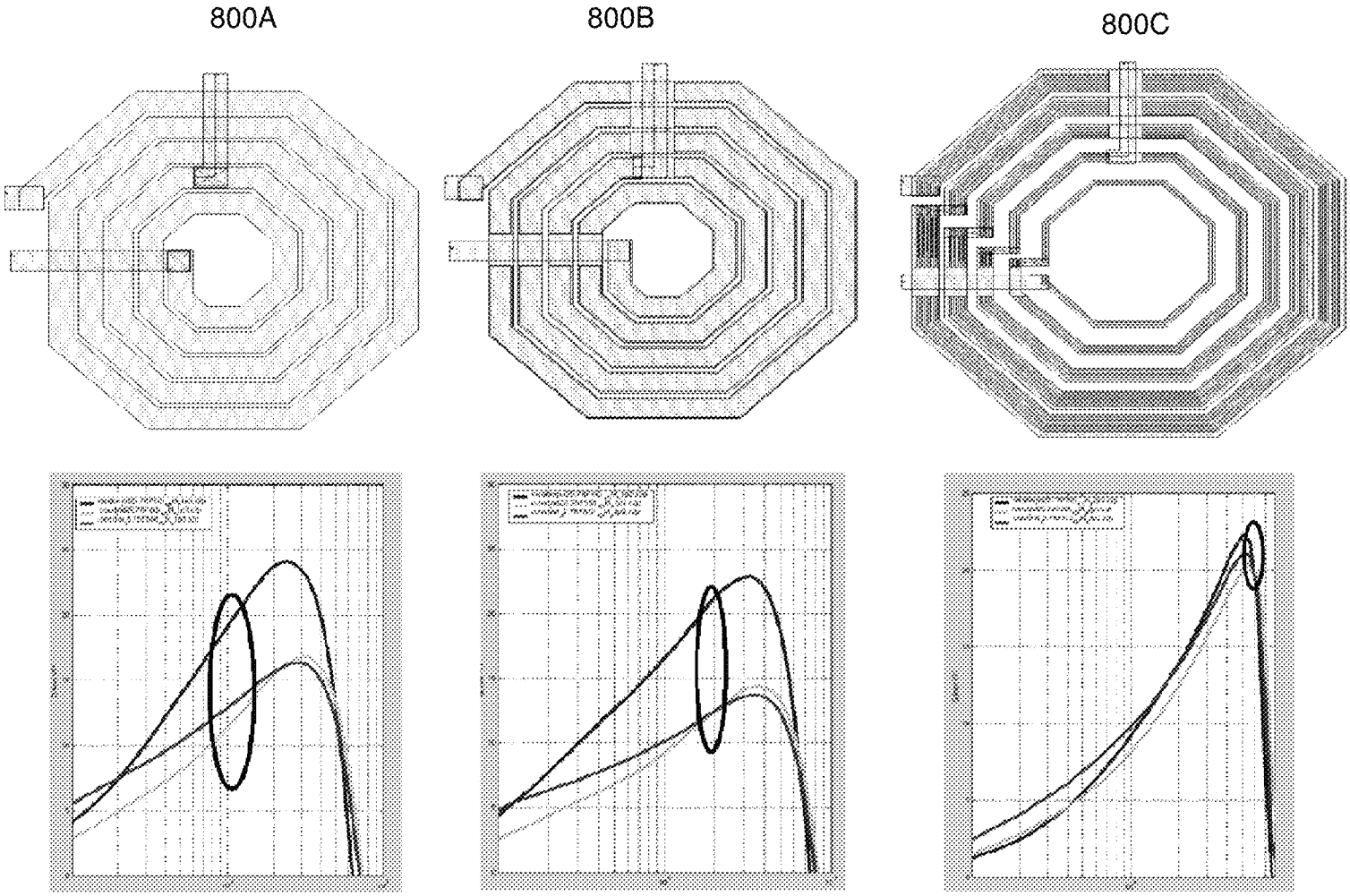
FIG. 8 shows comparison graphs between the multi-port inductors described herein and conventional inductors, demonstrating a performance improvement in accordance with aspects of the present invention.

FIG. 8 shows comparison graphs between the multi-port inductors described herein and conventional inductors. More specifically, the graphs of FIG. 8 demonstrate the area savings of the multi-port inductors 800C described herein when compared to discrete inductors shown at reference numerals 800A and 800B. More specifically, the graphs of FIG. 8 show a higher performance between the multi-port inductors 800C and a standard inductor 800A and a stacked multiport inductor 800B.

The method(s) as described above is used in the fabrication of integrated circuit chips. The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed:

1. A multiport inductor structure comprising a plurality of stacked and non-stacked conductors which are structured and arranged in turns to obtain symmetry between a plurality of selected input terminals connecting to respective ones of the plurality of conductor, wherein the stacked and non-stacked conductors are symmetrical between pairs of terminals, with an outer segment being in series, a middle segment being in parallel and an inner segment being single-layered.

2. The multiport inductor structure of claim 1, wherein the plurality of conductors comprises:

a first section of serially stacked turns of metal wiring segments;

a second section of parallel stacked turns of metal wiring segments; and a third section of non-stacked metal wiring segments.

3. The multiport inductor structure of claim 2, wherein the first section of the serially stacked turns, the second section of the parallel stacked turns and the third section of the non-stacked metal wiring segments are provided in a spiral configuration.

4. The multiport inductor structure of claim 2, wherein;

each of the first section, the second section and the third section include metal wiring segments have varying width and spacing therebetween; and a width of each metal wiring segment of the first section, the second section and the third section reduces as each metal wiring segment of the first section, the second section and the third section goes toward a center and spacing between adjacent metal wiring segments increases as each metal wiring segment of the first section, the second section and the third section goes toward the center.

5. The multiport inductor structure of claim 1, wherein a width or the diameter of each of the plurality of conductors is reduced at a constant rate or monotonic rate at is turns towards a center.

6. The multiport inductor structure of claim 1, wherein a spacing between each consecutive turn of the plurality of conductors increases at a constant rate or monotonic rate.

7. The multiport inductor structure of claim 6, wherein the spacing between each consecutive turn increases periodically.

8. The multiport inductor structure of claim 4, wherein at least one of the width and spacing of an upper turn is different from a lower turn for the metal wiring segments of the first section and the second section.

9. The multiport inductor structure of claim 4, wherein top metal wiring structures of the first section are offset vertically from bottom metal wiring structures of the first section.

10. The multiport inductor structure of claim 2, wherein the second section includes top wiring structures and bottom wiring structures of the plurality of conductors connected in parallel through a plurality of via interconnects along their length.

11. The multiport inductor structure of claim 2, wherein the first section provides a low frequency band, the second section provides an intermediate frequency band and the third section provides a high frequency band.

12. The multiport inductor structure of claim 1, wherein the symmetric inductor structure is a 3-dimensional structure.

13. The multiport inductor structure of claim 1, wherein a patterned ground shield is provided under spiral turns that correspond to lower frequencies.

14. The multiport inductor structure of claim 1, wherein:

terminals taken between outermost pair of the plurality of conductors comprise an inductor to be used at lowest frequency band;

terminals taken between intermediate pair of the plurality of conductors comprise an inductor to be used at intermediate frequency band; and terminals taken between an innermost pair of the plurality of conductors comprise an inductor to be used at highest frequency band.

15. The multiport inductor structure of claim 1, wherein the outer segment, the middle segment and the inner segment are in a spiral arrangement.

16. The multiport inductor structure of claim 1, wherein:

an upper layer of metal wiring structures are upper conductors including includes a plurality of upper metal wiring segments;

a first group of the plurality of upper metal wiring segments is a single stacked wiring structure;

a second group of the plurality of upper metal wiring segments are multiple stacked wiring segments, corresponding to a lower conductor which includes lower wiring segments serially connected to plural of the second group of the plurality of upper metal wiring segments by via interconnects forming an inductive wiring structure; and a first group of lower metal wiring segments are connected in parallel to respective upper wiring segments of the second group by a plurality of via interconnects along their lengths.

17. The multiport inductor structure of claim 1, wherein spacings between adjacent metal wiring segments of the stacked and non-stacked conductors increase between adjacent metal wiring segments as winding toward a center and widths of the metal wiring segments decrease as winding toward the center.

* * * * *